US005333206A

United States Patent [19]

Koss

[11] Patent Number: 5,333,206

[45] Date of Patent: Jul. 26, 1994

[54] DUAL ELEMENT HEADPHONE

[75] Inventor: Michael J. Koss, Glendale, Wis.

[73] Assignee: Koss Corporation, Milwaukee, Wis.

[21] Appl. No.: 854,479

[22] Filed: Mar. 18, 1992

[51] Int. Cl.[5] ..... H04R 25/00

[52] U.S. Cl. ..... 381/183; 381/187; 381/155; 381/25

[58] Field of Search ..... 381/183, 187, 155, 25; 181/144, 129

[56] References Cited

U.S. PATENT DOCUMENTS

| | | | |
|---|---|---|---|
| 3,609,240 | 9/1971 | Fixier | 381/25 |
| 4,110,583 | 8/1978 | Lepper | 381/183 |
| 4,972,491 | 11/1990 | Wilcox, Jr. | 381/187 |

FOREIGN PATENT DOCUMENTS

| | | | |
|---|---|---|---|
| 0023601 | 3/1978 | Japan | 381/183 |

*Primary Examiner*—Curtis Kuntz
*Assistant Examiner*—Sinh Tran
*Attorney, Agent, or Firm*—Whyte Hirschboeck Dudek

[57] ABSTRACT

A dual element headphone, including a first acoustic transducer mounted within a first housing so as to direct sound in a certain direction out of the first housing. The first housing is sized small enough so as to at least partially fit into the cavum concha of a listener's ear, and yet be larger in area than the entrance of the external acoustic meatus of the listener's ear. The first acoustic transducer is supported in the listener's ear so as to direct the sound generated by the transducer toward the entrance of the external acoustic meatus. A second acoustic transducer is mounted within a second housing. That second housing is substantially larger than the first housing, and overlies at least a portion of the auricle of the listener's ear. A crossover circuit divides the electrical signals received by the headphone, and transmits signals for higher frequencies to the first, smaller transducer and signals for lower frequencies to the second, larger transducer. The disclosure includes a headband and mounting plate, providing a set of these transducers for association with each ear. The first transducer may be flexibly mounted for improved comfort and sound fidelity.

19 Claims, 2 Drawing Sheets

DUAL ELEMENT HEADPHONE

BACKGROUND OF THE INVENTION

This invention relates to headphones for sound reproduction with high fidelity, and in particular to dual element headphones having one transducer for each ear directed to reproducing higher frequencies and one transducer for each ear directed to reproducing lower frequencies.

Designers of loudspeakers have long recognized the need for more than a single acoustic transducer to faithfully reproduce the entire audio spectrum. Quality loudspeakers may contain from two to five separate acoustic transducers, each designed to operate over a specific portion of the audio spectrum. Crossover networks are employed to distribute the plied audio signal to the proper acoustic transducer and these typically include circuits comprised of resistors, capacitors and inductors.

In the same vein, headphones having two transducer elements for each side are known in the art. Refer particularly, for instance, to Piribauer, U.S. Pat. No. 3,943,304, wherein there is disclosed a headphone speaker system which combines a dynamic transducer for lower frequencies with an electrostatic transducer for higher frequencies. Similarly, the disclosure of Mathis, U.S. Pat. No. 4,418,248, shows use of two transducers, in this case using a dynamic transducer for lower frequencies and a piezoelectric transducer for higher frequencies. And Andre et al, U.S. Pat. No. 4,965,836 discloses use of two dynamic transducers, a larger one for lower frequencies and a smaller one for higher frequencies. In each of the headphones disclosed in these patents, the transducers are oriented substantially coaxially, so that the sound from the two transducers emanates in almost entirely the same direction.

This invention relates to improvements to the headphone and loudspeaker apparatus set forth above and to solutions to some of the problems raised or not solved thereby.

SUMMARY OF THE INVENTION

The invention comprises a dual element headphone for use by a listener. According to this invention, a first acoustic transducer is mounted within a first housing so as to direct sound in a certain direction out of the first housing. The first housing is sized small enough so as to at least partially fit into the cavum concha of a listener's ear, and yet be larger in area than the entrance of the external acoustic meatus of the listener's ear. Means are provided for supporting the first acoustic transducer in the listener's ear so as to direct the sound generated by the transducer toward the entrance of the external acoustic meatus. A second acoustic transducer is mounted within a second housing. That second housing is substantially larger than the first housing, and connected to the supporting means so as to overlie at least a portion of the auricle of the listener's ear. Of course means are provided for dividing the electrical signals received by the headphone, and transmitting signals for higher frequencies to the first, smaller transducer and signals for lower frequencies to the second, larger transducer. The supporting means would normally include a headband and mounting plate, providing a set of these transducers for association with each ear. The first transducer may be flexibly mounted to the supporting means for improved comfort and sound fidelity.

Other objects and advantages of the invention will become apparent hereinafter.

DESCRIPTION OF THE PREFERRED EMBODIMENT

Figure 1:
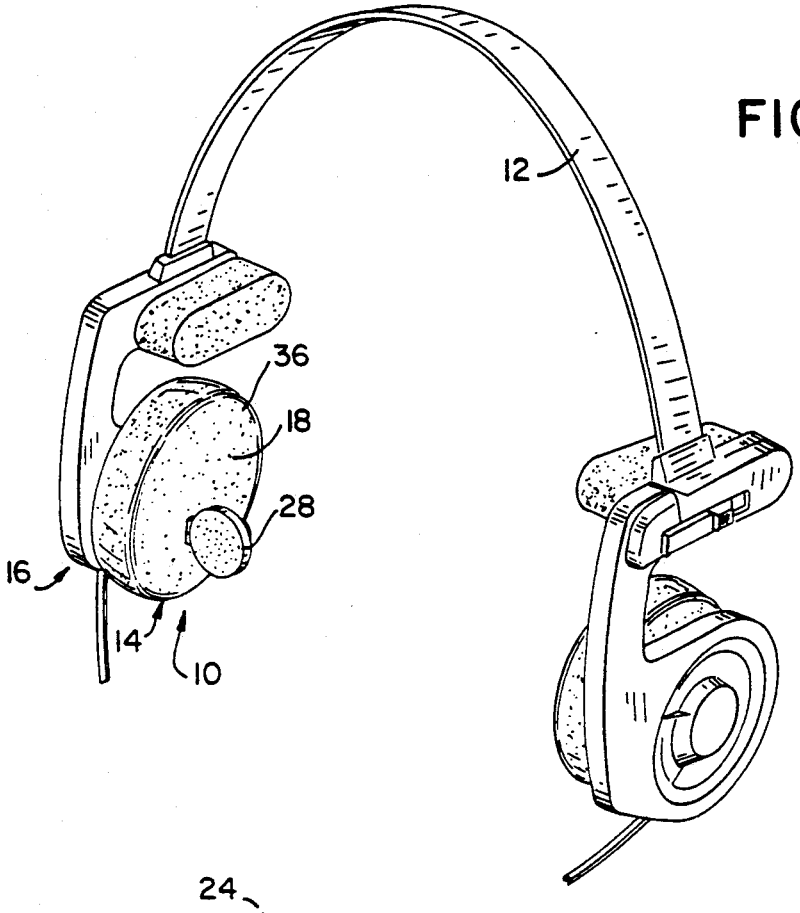
FIG. 1 is a perspective view of a headphone constructed according to a preferred embodiment of the invention.

Referring now to FIG. 1, there is shown a headphone apparatus 10 constructed according to a preferred embodiment of the invention. The headphone 10 includes a headband 12, generally fitted over the head of a listener. To each end of headband 12 is attached a transducer assembly 14, by means of an earcup assembly 16.

Figure 2:
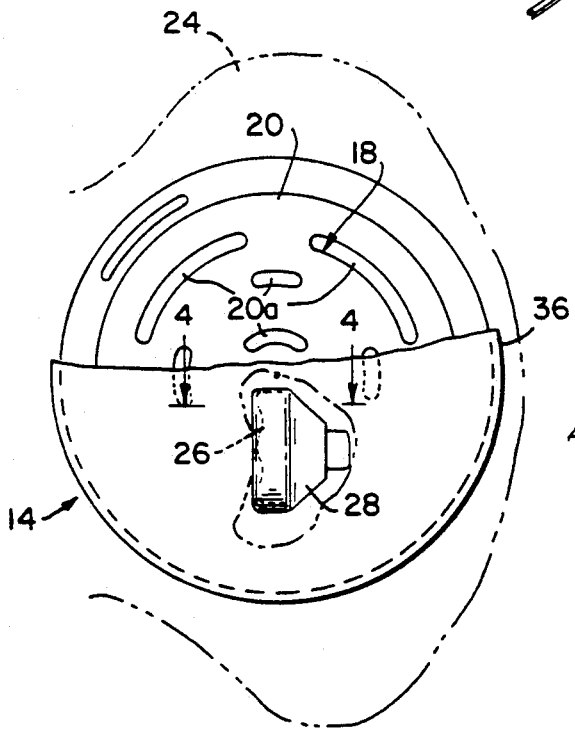
FIG. 2 is a side elevational view, partially in section, of the transducer assembly of the headphone shown in FIG. 1.
Figure 3:
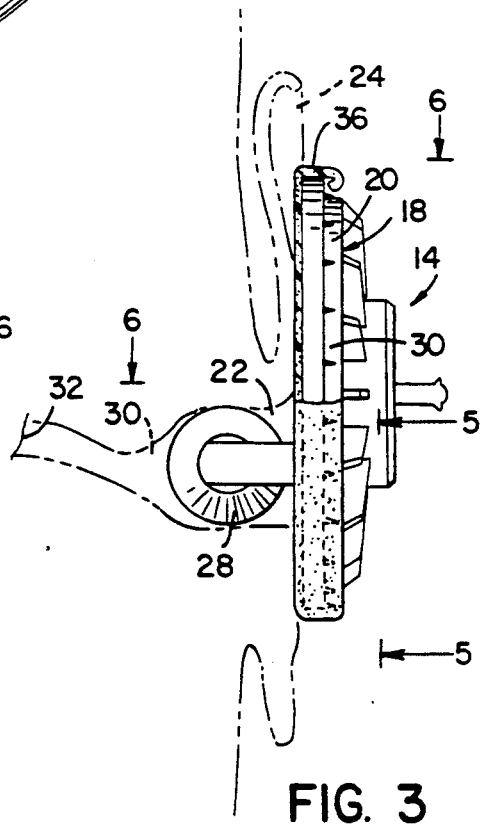
FIG. 3 is a front elevational view, partially in section, of the transducer assembly of the headphone shown in FIG. 1.
Figure 6:
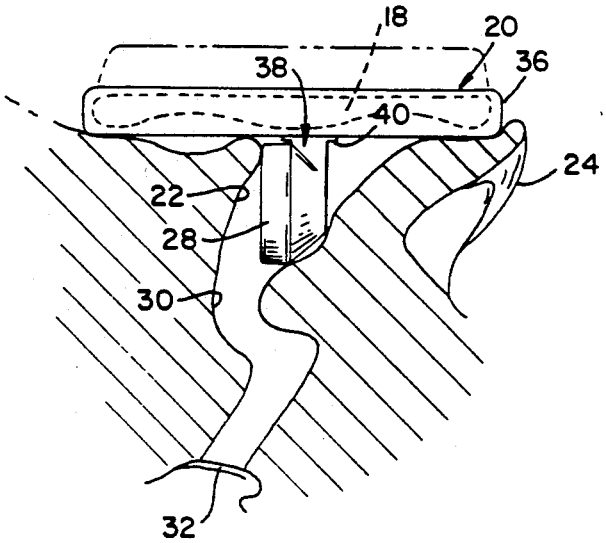
FIG. 6 is a cross sectional view, taken generally along line 6—6 of FIG. 3.

As shown in FIGS. 2, 3 and 6, according to the invention each transducer assembly 14 includes a large transducer 18, mounted by any suitable means to the earcup assembly 16. Generally such mounting means will include a mounting plate 20 to which large transducer 18 is attached. Since a portion of mounting plate 20 is positioned in front of transducer 18, the mounting plate is provided with slots **20*a*, to permit passage of sound therethrough. Large transducer 18 is of a size substantially larger than the cavum concha 22 of the listener's ear. Mounting plate 20 is connected to the headband so as to position itself and large transducer 18 substantially flat against the listener's auricle 24**.

The invention also calls for another, smaller transducer 26 affixed within a housing 28. This housing 28 is associated with large transducer 18 so that sound emanates from the smaller transducer 26 in a direction transverse to the direction of the sound emanating from the large transducer. In the embodiment shown in the drawing FIGURES, the housing 28 is attached to the mounting plate 20 and projects outwardly therefrom. As shown in FIGS. 3 and 6, housing 28 projects substantially perpendicular to the mounting plate 20, and is sized so as to at least partially fit into the cavum concha 22 of the listener's ear. Housing 28 is larger in area, however, than the entrance of the external acoustic meatus 30 of the listener's ear. When in use by the listener, then, housing 28 projects into the cavum concha 22 and aligns the smaller transducer 26 generally with the entrance to the external acoustic meatus 30. With smaller transducer 26 thus positioned, the sound emanating therefrom is transmitted almost directly to the tympanum 32 of the listener's ear.

Figure 4:
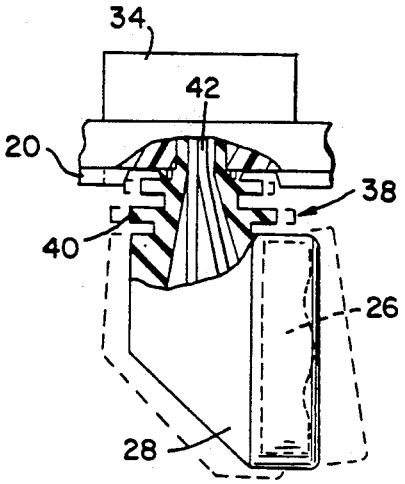
FIG. 4 is a top plan view, partially in section, of the smaller transducer, taken along line 4—4 of FIG. 2.

The invention also provides for conventional crossover filter means 34 (FIG. 4) for dividing the electrical signal into a lower frequency component and higher frequency component. By this means 34 the lower frequency component is transmitted to the larger transducer 18 while the higher frequency component is transmitted to the smaller transducer 26. Since the smaller transducer 26 is positioned almost directly facing the tympanum 32, the higher frequencies are transmitted to the tympanum with great fidelity. Correspondingly, since the larger transducer 18 is positioned further away from the tympanum 32, the relatively larger amplitudes of the lower frequencies are prevented from uncomfortably over-exercising the tympanum.

Figure 5:
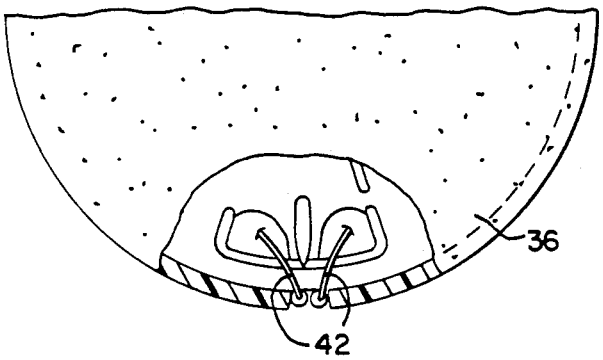
FIG. 5 is a side elevational view, partially cut away, of the transducer assembly of the headphone shown in FIG. 4 along line 5—5.

For greater comfort in using and wearing the headphone 10, it is known to provide padding material, such as foam pads 36, to cover the large transducer 18 and mounting plate 20. In the present invention, in order to further improve comfort in use, the mounting of the housing 28 to the mounting plate 20 may be a flexible mounting 38. This flexible mounting 38 includes a boot 40 attached to the plate 20, the other end of the boot easily carrying the relatively lightweight housing 28. The signals to the smaller transducer 26 should then be carried by some flexible means such as flexible wires 42 (FIG. 5) rather than some other means such as solid traces.

While the apparatus hereinbefore described is effectively adapted to fulfill the aforesaid objects, it is to be understood that the invention is not intended to be limited to the specific preferred embodiment of dual element headphone set forth above. Rather, it is to be taken as including all reasonable equivalents within the scope of the following claims.

I claim:

1. A headphone speaker system comprising:

a first acoustic transducer for producing sound, mounted to a mounting plate and arranged to direct the produced sound in a first predetermined direction; and a second acoustic transducer for producing sound, mounted to said mounting plate and arranged to direct sound in a second predetermined direction transverse to said first predetermined direction;

said first acoustic transducer sized and configured so as to fit into the cavum concha of a listener's ear; and said second transducer being substantially larger than said first transducer and arranged on said mounting plate so as to substantially overlie at least a portion of the auricle of said listener's ear.

2. The headphone speaker system as recited in claim 1 further comprising means for receiving electrical signals to be converted to sound, and means for dividing said electrical signals and sending signals for higher frequencies to said first transducer and sending signals for lower frequencies to said second transducer.

3. The headphone speaker system as recited in claim 1 wherein said first acoustic transducer is mounted to said mounting plate by means of a flexible mounting.

4. The headphone speaker system as recited in claim 1 wherein said first transducer is positioned by said mounting plate so as to direct sound into the external acoustic meatus of said listener's ear.

5. The headphone speaker system as recited in claim 1 further comprising a headband connected to said mounting plate, for supporting said transducers in proximity to said listener's ear.

6. The headphone speaker system as recited in claim 5 wherein said mounting plate is connected at one end of said headband, and further comprising another mounting plate, also carrying a first and second transducer, for association with the listener's other ear.

7. A headphone for use by a listener, said headphone comprising:

a headband fitted generally to the head of the listener;

a transducer assembly attached to each end of said headphone, each said transducer assembly including:

a mounting means for mounting said transducer assembly to said headband;

a first acoustic transducer for producing sound, mounted to said mounting means and arranged to direct the produced sound in a first predetermined direction; and a second acoustic transducer for producing sound, mounted to said mounting means and arranged to direct sound in a second predetermined direction transverse to said first predetermined direction and generally toward the opposite transducer assembly;

said first acoustic transducer sized and configured so as to fit into the cavum concha of a listener's ear; and said second acoustic transducer being substantially larger than said fist acoustic transducer and mounted to said mounting means so as to substantially overlie at least a portion of the auricle of said listener's ear.

8. The headphone as recited in claim 7 further comprising means for receiving electrical signals to be converted to sound and means for dividing said electrical signals and sending signals for higher frequencies to said first transducer and sending signals for lower frequencies to said second transducer.

9. The headphone as recited in claim 7 wherein said first acoustic transducer is flexibly mounted to said mounting means.

10. The headphone as recited in claim 7 wherein said first acoustic transducer is positioned by said mounting means and said headband so as to direct sound into the external acoustic meatus of said listener's ear.

11. A dual element headphone for use by a listener comprising:

a first acoustic transducer mounted within a first housing so as to direct sound in a certain direction out of said first housing, said first housing sized and configured so as to at least partially fit into the cavum concha of a listener's ear, said first housing being larger in area than the entrance of the external acoustic meatus of the listener's ear;

a supporting means for supporting said first housing in the listener's ear so as to direct sound toward the entrance of said external acoustic meatus;

a second acoustic transducer mounted within a second housing, said second housing being substantially larger than said first housing, and connected to said supporting means so as to overlie at least a portion of the auricle of the listener's ear.

12. The dual element headphone as recited in claim 11 further comprising:

means for receiving electrical signals to be converted to sound; and means for dividing said electrical signals and sending signals for higher frequencies to said first transducer and sending signals for lower frequencies to said second transducer.

13. The dual element headphone as recited in claim 11 wherein said first housing is flexibly mounted to said supporting means.

14. The headphone speaker system as recited in claim 11 wherein said supporting means includes a headband mounted to said housings by a first mounting plate, for supporting said housings in proximity to an ear of a listener.

15. A headphone speaker system as recited in claim 14 wherein said supporting means further includes:

a second mounting plate connected at the opposite end of said headband, also carrying a first and second transducer, for association with the listener's other ear.

16. A headphone speaker system for use by a listener comprising:

a first acoustic transducer for producing sound, mounted to a mounting plate and arranged to direct the produced sound in a first predetermined direction, and wherein said first acoustic transducer is sized, configured and oriented on said mounting plate so as to substantially fit into the cavum concha of said listener's ear; and a second acoustic transducer for producing sound mounted to said mounting plate and arranged to direct sound in a second predetermined direction transverse to said first predetermined direction;

said second acoustic transducer oriented on said mounting plate so as to substantially overlie at least a portion of the auricle of said listener's ear.

17. The headphone speaker system as recited in claim 16 further comprising means for receiving electrical signals to be converted to sound, and means for dividing said electrical signals and sending signals for higher frequencies to said first transducer and sending signals for lower frequencies to said second transducer.

18. A dual element headphone for use by a listener comprising:

a first acoustic transducer mounted within a first housing so as to direct sound in a certain direction out of said first housing, said first housing sized and configured so as to at least partially fit into the cavum concha of a listener's ear;

a supporting means for supporting said first housing so as to direct sound toward the entrance of the listener's external acoustic meatus;

a second acoustic transducer mounted within a second housing, supported by said supporting means so as to direct sound transversely to the direction of sound directed by said first housing and overlie at least a portion of the listener's ear;

means for receiving electrical signals to be converted to sound; and means for dividing said electrical signals and sending signals for higher frequencies to said first acoustic transducer and sending signals for lower frequencies to said second acoustic transducer.

19. A dual element headphone for use by a listener comprising:

a first acoustic transducer mounted within a first housing so as to direct sound in a certain direction out of said first housing so as to divert sound toward the entrance of the listener's external acoustic meatus, said first housing sized and configured so as to at least partially fit into the cavum concha of a listener's ear;

a second acoustic transducer mounted within a second housing so as to overlie at least a portion of the listener's ear;

a headband support means connected to said housings for supporting said transducers in proximity to the listener's ear, and including:

a first mounting plate connected at one end of said headband, to which mounting plate said first and second housings are mounted; and a second mounting plate connected at the opposite end of said headband, also carrying a first and second transducer, for association with the listener's other ear.

* * * * *